US006341433B1

(12) United States Patent
Nakamura

(10) Patent No.: US 6,341,433 B1
(45) Date of Patent: Jan. 29, 2002

(54) SPIKED SHOES

(75) Inventor: Yukiyasu Nakamura, Osaka (JP)

(73) Assignee: SSK Corporation, Osaka (JP)

( * ) Notice: Subject to any disclaimer, the term of this patent is extended or adjusted under 35 U.S.C. 154(b) by 0 days.

(21) Appl. No.: 09/633,842

(22) Filed: Aug. 7, 2000

Related U.S. Application Data

(63) Continuation-in-part of application No. 09/207,606, filed on Dec. 9, 1998, now abandoned.

(30) Foreign Application Priority Data

May 18, 1998 (JP) ..... 10-135214

(51) Int. Cl.[7] ..... A43B 5/00
(52) U.S. Cl. ..... 36/67 R; 36/102
(58) Field of Search ..... 36/126, 127, 128, 36/129, 59 R, 67 R, 67 A, 67 B, 102, 31

(56) References Cited

U.S. PATENT DOCUMENTS

| | | | | |
|---|---|---|---|---|
| 834,062 A | | 10/1906 | Kaho | |
| 912,172 A | | 2/1909 | Rooney | |
| 1,846,617 A | * | 2/1932 | Seremba | 36/126 |
| 1,867,219 A | | 7/1932 | Harper | |
| 2,061,962 A | * | 11/1936 | Gabriele | 36/59 R |
| 2,061,963 A | * | 11/1936 | Gabriele | 36/59 R |
| 2,678,507 A | | 5/1954 | Dye | |
| 3,029,529 A | | 4/1962 | Schwartz | |
| 3,127,687 A | | 4/1964 | Hollister et al. | |
| 3,283,424 A | | 11/1966 | Struntz | |
| 3,581,414 A | * | 6/1971 | Crawford | 36/59 R |
| 4,107,858 A | | 8/1978 | Bowerman et al. | |
| 4,315,374 A | | 2/1982 | Sneeringer | |
| 4,546,559 A | * | 10/1985 | Dassler | 36/31 |
| 4,914,838 A | * | 4/1990 | Ihlenburg | 36/102 |
| 5,473,827 A | | 12/1995 | Barre et al. | |
| D368,360 S | * | 4/1996 | Wolfe | D2/962 |
| 5,862,614 A | * | 1/1999 | Koh | 36/31 |
| 6,178,667 B1 | * | 1/2001 | Kaneko et al. | 36/126 |

FOREIGN PATENT DOCUMENTS

| | | |
|---|---|---|
| JP | 37-26109 | 9/1962 |
| JP | 63-138111 | 9/1988 |
| JP | 9-47303 | 2/1997 |

* cited by examiner

*Primary Examiner*—M. D. Patterson
(74) *Attorney, Agent, or Firm*—Wenderoth, Lind & Ponack, L.L.P.

(57) ABSTRACT

Spiked shoes enable the wearer to kick the ground with a minimum loss of power. The spiked shoes have spikes secured to the toe and heel portions of the sole to extend across the longitudinal centerline of the sole. An additional spike is mounted to the sole at its intermediate portion between the toe and heel portions to extend across the fourth metatarsal of the wearer's foot. While the wearer is walking or running, the additional spike bears the wearer's weight at the root of the fourth toe. The wearer can thus kick the ground with a minimum loss of power. As a result, this spike cooperates with the spikes at the toe and heel portions to grip the ground firmly so that the wearer can kick the ground strongly even with the heels off ground.

6 Claims, 2 Drawing Sheets

SPIKED SHOES

This is a Continuation-in-Part of Ser. No. 09/207,606 filed on Dec. 9, 1998, now abandoned.

BACKGROUND OF THE INVENTION

This invention relates to spiked shoes in general, and spiked shoes for baseball in particular.

This type of spiked shoes have spikes provided at its toe and heel portions so as to extend across the longitudinal centerline of the sole. Ordinarily, these spikes have base plates mounted to the toe and heel portions of the sole. Each base plate further includes a pair of spikes provided on both sides thereof. Thus it was customary to provide three spikes at the toe portion and three spikes at the heel portion of shoes. While the wearer is walking or running, the spikes bite into the ground, preventing slippage.

A human foot is made up of a large number of bones of different sizes. Functionally, these bones are divided into inside bones which support the weight of the body, and outside bones that help a smooth heel-to-toe weight shift. Ordinarily, man lands each foot on the ground with the heel first. Then, the weight shifts toward the tiptoe via the outside bones, and the foot takes off the ground by kicking the ground with the first toe. During such weight shift, a large part of the weight acts on the fourth metatarsal of the foot, especially at the joint between the fourth toe and the fourth metatarsal, i.e. at the root of the fourth toe.

In spite of this fact, conventional spiked shoes had no spike under the root of the fourth toe. Thus, a large force tends to act on the spikes of the toe portion when the wearer kicks the ground. This is especially true for spiked shoes for baseball, because in most cases, before making a move, a baseball player stands with the heels off ground so that he can make as quick a start as possible. Thus, when the player kicks the ground, only the toe portion of the sole is in contact with the ground, so that it is difficult to grip the ground with a sufficiently strong force.

An object of this invention is to provide spiked shoes which can grip the ground firmly when the wearer kicks the ground so that he can kick the ground with minimum loss of power.

SUMMARY OF THE INVENTION

According to this invention, there is provided a spiked shoe comprising a sole having a toe portion, a heel portion and an intermediate portion between the toe portion and the heel portion, wherein spikes are provided at the toe and heel portions of the sole so as to extend across a longitudinal centerline of the sole, characterized in that an additional spike is provided at the intermediate portion of the sole so as to extend across the fourth metatarsal of the wearer's foot.

In other words, the spiked shoes according to the present invention are provided with additional spikes at the toe portion and the intermediate portion of shoes in addition to six spikes provided on the conventional spiked shoes.

While the wearer is walking or running, the spike extending across the longitudinal centerline of the sole supports the weight of the wearer at the root of the fourth toe. Thus, the additional spike cooperates with the spikes secured to the toe and heel portions of the sole to enable the wearer to kick the ground strongly with minimum loss of power even with the heels off ground.

From another aspect of the invention, there is provided a spiked shoe wherein base plates having the spikes extending across the longitudinal centerline of the sole are mounted to the toe and heel portions of the sole, respectively, and another base plate having an additional spike is mounted to the intermediate portion of the sole, each of the base plates further having a pair of spikes provided on both sides of the longitudinal centerline.

In this arrangement, the pairs of spikes bear lateral kicking forces, so that this spiked shoes can grip the ground firmly when the wearer moves not only back and forth but sideways. When the spikes are worn, the base plates can be easily removable for replacement.

The base plate mounted to the intermediate portion may have an arcuately convexed front edge extending along a line connecting the roots of the toes of the wearer's foot.

With this arrangement, when the wearer kicks the ground, the sole is bent smoothly along the line connecting the roots of the toes. This minimizes the burden on the wearer's foot.

In the arrangement in which the base plate mounted to the toe portion has an arcuately convexed rear edge, and the base plate mounted to the intermediate portion has an arcuately convexed front edge extending along a line connecting the roots of the toes of the wearer's foot, the base plates will never hinder smooth flexing of the toe portion of the sole, so that the toes can be bent smoothly.

Other features and objects of the present invention will become apparent from the following description made with reference to the accompanying drawings, in which:

DETAILED DESCRIPTION OF THE PREFERRED EMBODIMENT

Figure 1:
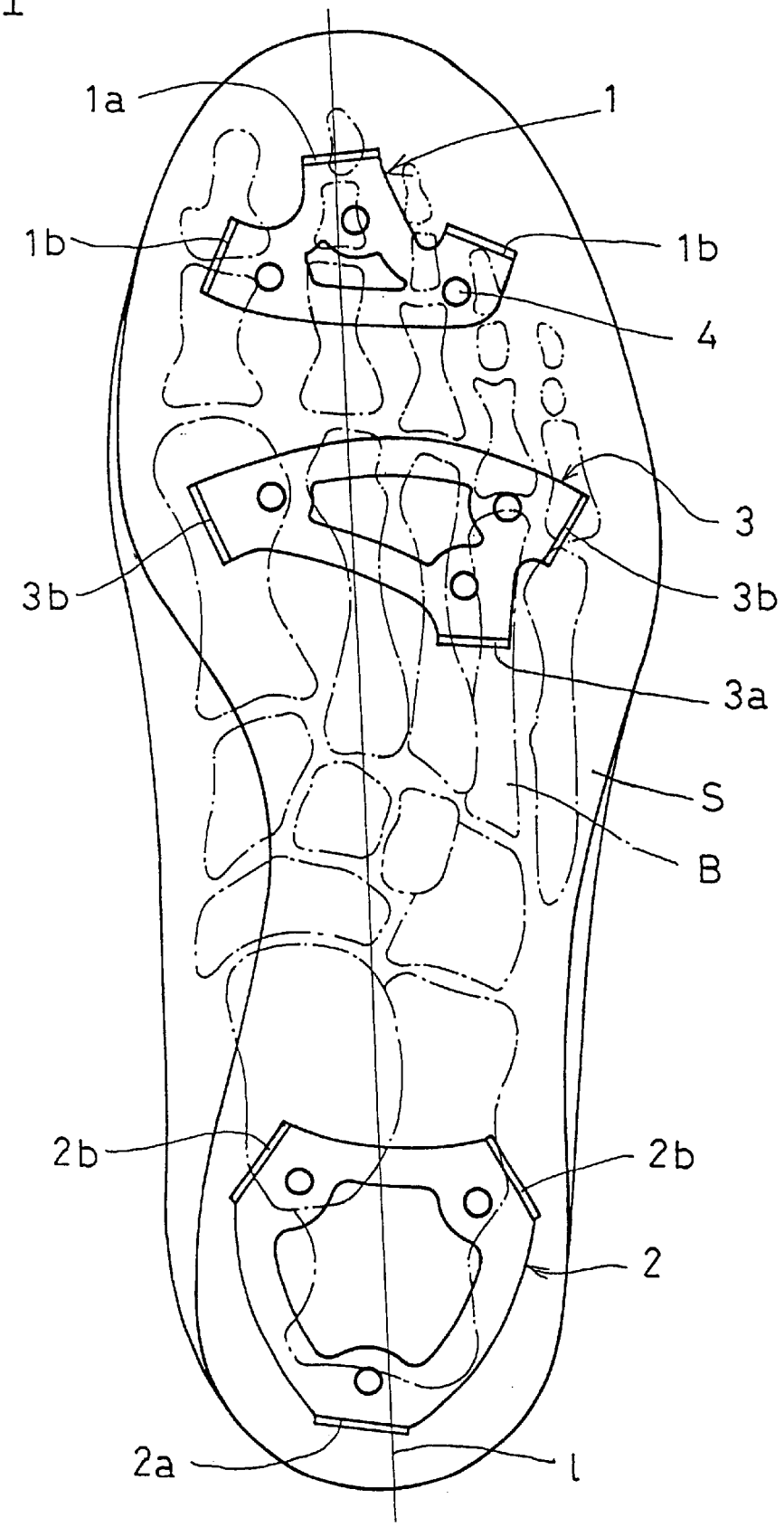
FIG. 1 is a bottom plan view of a spiked shoe embodying this invention.
Figure 2:
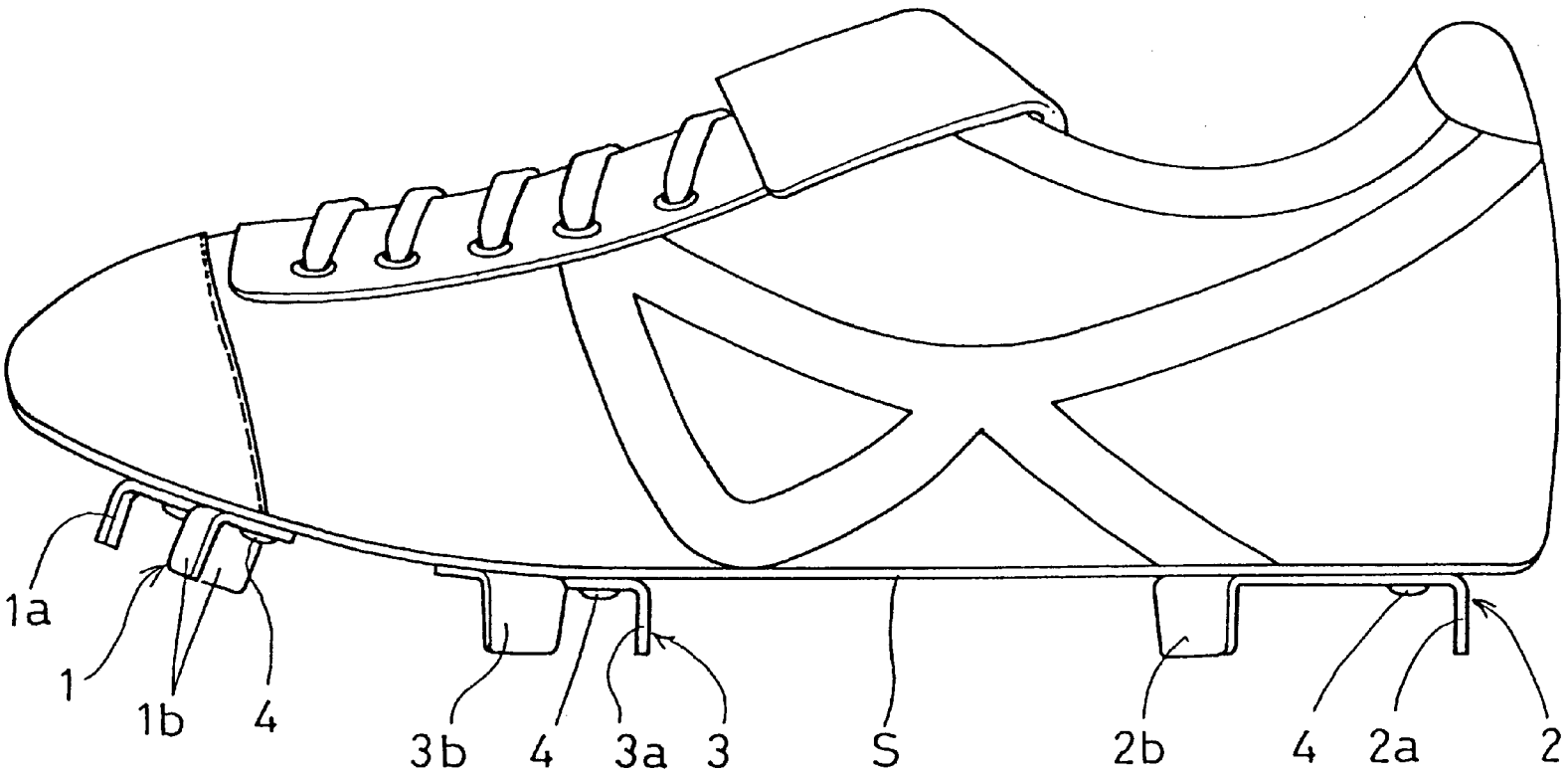
FIG. 2 is a side view of the same.

The spiked shoe shown in FIGS. 1 and 2 has metal plates 1, 2 and 3 having spikes and secured to the toe portion, heel portion and intermediate portion of the sole S, respectively. Each metal plate has a plurality of mounting holes and is secured to the sole S by inserting rivets into the mounting holes and caulking their ends protruding from the holes as shown at 4 in FIG. 2.

The spikes are formed by bending peripheral portions of the metal plates 1–3 downward. The foremost spike 1*a* of the toe plate 1 and the rearmost spike 2*a* of the heel plate 2 extend across the longitudinal centerline 1 of the sole so as to support the kicking forces. A spike 3*a* of the intermediate plate 3 extends across the fourth metatarsal of the wearer's foot, i.e. across a portion of the sole corresponding to the fourth metatarsal. Each metal plate 1, 2, 3 further includes a pair of spikes 1*b*, 2*b*, 3*b*, respectively, arranged on both sides of the longitudinal centerline 1 of the sole and having one side thereof facing inward. The intermediate plate 3 has an arcuately convex front edge extending substantially along a portion of the sole corresponding to the line connecting the roots of the toes together. The toe plate 1 has an arcuately convex rear edge.

The term "roots of the toes" as used in the present invention refers to the portions of the foot where there are articular capsules of metatarsophalangeal joints. When the wearer puts on shoes that fit his feet, the roots of the toes, i.e. articulate capsules extend substantially along the widest portion of each shoe, which is often called the "ball". The body weight of the wearer first rests on the ball. As shown in FIG. 1, the intermediate base plate 1 is preferably provided such that the straight line that passes both ends of the front arcuate edge thereof is substantially perpendicular to centerline l.

When a base runner turns around a base in baseball, when a right hitter swings a bat, and when a fielder dashes in the forward left direction, the shoe sole is bent along line a or b in FIG. 1. For example, when a runner turns around a base in baseball, the shoe sole is bent along line a. When a left hitter swings a bat and when a fielder dashes in a forward right direction, the left shoe sole is bent along line b. The greater the angle θ between lines a and b, the more easily the shoe sole can be bent. Thus, a player can run, swing and dash more smoothly. By arranging the rear edge of the front base plate 1 and the front edge of the intermediate plate in the above-described manner, it is possible to sufficiently increase the angle θ.

While the wearer of the shoes is walking or running, the spike 3*a* extending across the fourth metatarsal of the foot securely supports the weight of the wearer at the root of the fourth toe, so that the wearer can kick the ground with minimum loss of power. The spikes la and 2*a* cooperate with the spike 3*a* to increase the spiking forces.

The three pairs of spikes 1*b*, 2*b*, 3*b* bear the kicking force when the wearer sidesteps. As a whole, the spikes can bear not only the forward and backward kicking forces but lateral kicking forces. Also, the wearer can kick the ground hard with the heels off ground. When the spikes become worn, the plates can be removed for replacement by cutting off the caulked portions 4 with a cutter such as a nipper.

Since the rear edge of the toe plate 1 is arcuately convex and the front edge of the intermediate plate 3 is arcuately convex along the line connecting the roots of the toes, the plates 1 and 3 will never hinder smooth flexing of the toes, so that the toes can be bent easily along the line connecting the roots of the toes when the wearer kicks the ground. This minimizes the burden on the wearer's foot.

When the wearer runs straight ahead at full speed, it is known that each foot lands on the ground with the heel first and then the pressure point moves along the outer side of the arch and the fourth metatarsal to the tiptoe. According to the present invention, besides the conventional two spikes 2*a* and 1*a* that are provided substantially perpendicularly to centerline 1 at the heel and tiptoe, the additional spike 3*a* is provided at the intermediate portion of the sole so as to extend substantially perpendicular to the centerline 1. Thus, at any moment while the shoe is on the ground, at least one of the three spikes 2*a*, 1*a* and 3*a* grips the ground firmly. This eliminates the possibility of rearward skid of the shoe while the wearer is running forward. The side spikes 2*b*, 3*b* and 1*b* cooperate to prevent a side skid of the shoe while the wearer is running straight ahead.

Practically all the movements in baseball start with the heels above the ground. A baseball player makes a first step with the spikes at his heels off the ground. If he slips in the first step, he may be tagged out at the second base, or may fail to catch a flyball or a grounder. The six spikes of the front and intermediate plates are arranged so that the wearer can make a first step in any direction with the heels up without slipping. Specifically, the front side spikes 1*b* are provided so as to flare or diverge rearwardly of the shoe. Conversely, the intermediate side spikes 3*b* are provided to flare or diverge forwardly of the shoe. The spikes 1*a* and 3*a* are arranged substantially perpendicular to the centerline l as described above.

When the wearer makes a first step in the forward right direction in FIG. 1, his body moves forward right and thus is supported almost entirely on the front right spike 1*b*. This spike 1*b* extends substantially perpendicular to the direction in which the wearer is moving and thus can grip the ground firmly while preventing a skid of the shoe. Similarly, when the wearer makes a first step in the forward left direction, the front left spike 1*b* is mainly used to support the body weight. When the wearer moves obliquely rearwardly, such as when an infielder jumps obliquely rearwardly to catch a line drive, one of the intermediate side spikes 3*b* grips the ground to support the force transmitted from the leg. When the wearer dashes straight ahead, the spikes 1*a* and 3*a* support the body. The six spikes 3*a*, 3*b*, 1*a* and 1*b*, which are arranged substantially in a circle, individually support the movement of the wearer in any direction.

Unlike a 100-meter dash, when a base runner runs to steal second or third, he keeps his body crouched, so that the heels of the shoes barely touch the ground. Thus, the feet land on the ground with the outer side of the arch of each foot first. That is, the portion of the foot where there is the fourth metatarsal lands on the ground first. The spike 3*a* provided under the fourth metatarsal thus grips the ground firmly even in such a case.

The front left (in FIG. 1) spike 1*b* is provided substantially under the articulate capsule of interphalangeal joint of hallux and forms an angle of less than 45° with respect to the centerline l. If a right-hitting batter begins to step forward his left foot earlier, anticipating a fast ball, but the ball actually thrown was a change-up, he has to delay his bat swing by momentarily standing firm on the big toe of the right foot. The spike 1*b* thereunder positively supports the shoe in such a case.

The spikes may be secured directly to the sole, not on the base plates.

The base plates and the spikes may be made from a metal as in the embodiment or from rubber or synthetic resin.

Also, base plates molded from a resin with metal spikes integrally embedded therein may be fixed to the sole of the shoe.

The spike shoes of the embodiment has three base plates each formed with three spikes. But four or more base plates each formed with one, two or three spikes may be used, provided the total number of spikes is nine. For example, instead of providing one base plate having three spikes, two base plates may be used, one of which has one spike and the other has two spikes.

What is claimed is:

1. A spiked shoe comprising:

a sole having a toe portion, a heel portion and an intermediate portion between said toe portion and said heel portion, said sole further having a longitudinal centerline, a front end at which said toe portion is located and a rear end at which said heel portion is located;

first and second plate-shaped spikes provided at said toe portion on both sides thereof, and a third plate-shaped spike provided on said toe portion between said first and second spikes so as to be substantially perpendicular to said centerline;

said third spike being located nearer to said front end than are said first and second spikes;

said first and second spikes extending obliquely inwardly toward said front end;

said first spike being provided substantially under a portion of the sole corresponding to the articulate capsule of the interphalangeal joint of the hallux;

fourth and fifth plate-shaped spikes provided at said intermediate portion on both sides thereof and a sixth plate-shaped spike provided at said intermediate portion between said fourth and fifth spikes so as to extend across a portion of the sole corresponding to the fourth metatarsal and so as to extend substantially perpendicular to said longitudinal centerline;

said sixth spike being located nearer to said rear end than are said fourth and fifth spikes;

said fourth and fifth plate-shaped spikes extending obliquely outwardly toward said front end and provided at a portion of the sole corresponding to the ball of the spiked shoe; and a seventh plate-shaped spike provided at said heel portion so as to extend substantially perpendicularly to said centerline.

2. The spiked shoe of claim 1 wherein said first spike forms an angle of not more than 45 degrees with respect to the centerline of said shoe.

3. The spiked shoe of claim 1, wherein said heel portion further has a pair of plate-shaped spikes disposed on either side of said seventh plate-shaped spike.

4. A spiked shoe comprising:

a sole having a toe portion, a heel portion and an intermediate portion between said toe portion and said heel portion, said sole further having a longitudinal centerline, a front end at which said toe portion is located and a rear end at which said heel portion is located;

a first base plate mounted at said toe portion, a second base plate mounted at said intermediate portion and a third base plate mounted at said heel portion;

said first base plate having a rear edge which is arcuately convex over the entire length thereof;

said second base plate having a front edge which is arcuately convex over the entire length thereof and extends under a portion of the sole corresponding to the articulate capsules of metatarsophalangeal joints;

said first base plate having first and second plate-shaped spikes provided on both sides thereof, and a third plate-shaped spike which is substantially perpendicular to said centerline;

said third spike being located between said first and second plate-shaped spikes and nearer to said front end than are said first and second plate-shaped spikes;

said first and second plate-shaped spikes extending obliquely inwardly toward said front end;

said first spike being provided substantially under a portion of the sole corresponding to the articulate capsule of the interphalangeal joint of the hallux;

said second base plate having fourth and fifth plate-shaped spikes provided on both sides thereof and a sixth plate-shaped spike provided at said intermediate portion between said fourth and fifth spikes so as to extend across a portion of the sole corresponding to the fourth metatarsal and so as to extend substantially perpendicular to said longitudinal centerline, said sixth spike being located nearer to said rear end than are said fourth and fifth spikes;

said fourth and fifth plate-shaped spikes extending obliquely outwardly toward said front end and provided at a portion of the sole corresponding to the ball of the spiked shoe; and a third base plate having a seventh plate-shaped spike provided at said heel portion so as to extend substantially perpendicularly to said centerline.

5. The spiked shoe of claim 4, wherein said first spike forms an angle of not more than 45 degrees with respect to the centerline of said shoe.

6. The spiked shoe of claim 4, wherein said heel portion further has a pair of plate-shaped spikes disposed on either side of said seventh plate-shaped spike.

* * * * *